US006328771B1

(12) United States Patent
Moreton

(10) Patent No.: US 6,328,771 B1
(45) Date of Patent: Dec. 11, 2001

(54) FUEL COMPOSITIONS CONTAINING LUBRICITY ENHANCING SALT COMPOSITIONS

(75) Inventor: David J. Moreton, Derbyshire (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/445,329

(22) PCT Filed: Apr. 7, 1999

(86) PCT No.: PCT/GB99/01064

§ 371 Date: Dec. 7, 1999

§ 102(e) Date: Dec. 7, 1999

(87) PCT Pub. No.: WO99/52995

PCT Pub. Date: Oct. 21, 1999

(30) Foreign Application Priority Data

Apr. 8, 1998 (GB) ..... 9807607

(51) Int. Cl.[7] ..... C10L 1/22

(52) U.S. Cl. ..... 44/335; 44/339; 44/340; 44/345

(58) Field of Search ..... 44/335, 339, 340, 44/341, 342, 344, 345, 329

(56) References Cited

U.S. PATENT DOCUMENTS

| | | | | |
|---|---|---|---|---|
| 2,907,646 | | 10/1959 | O'Kelly et al. | 44/63 |
| 3,799,942 | * | 3/1974 | Boocock et al. | 260/309.6 |
| 5,183,475 | | 2/1993 | Cardis et al. | 44/343 |

FOREIGN PATENT DOCUMENTS

| | | |
|---|---|---|
| 0074724A2 | 3/1983 | (EP) . |
| 0385778B1 | 9/1990 | (EP) . |

* cited by examiner

*Primary Examiner*—Margaret Medley
(74) *Attorney, Agent, or Firm*—Jeffrey F. Munson; Samuel B. Laferty; David M. Shold

(57) ABSTRACT

A fuel composition comprising a major amount of hydrocarbon fuel and a minor lubricity improving amount of a composition made by reacting component (A) with component (B) under unit-forming conditions;

component (A) comprising a carboxylic acid represented by the formula $$R\ (COOH)_n$$

wherein R is a hydrocarbon group of 2 to 30 carbon atoms and n is a number in the range of 1 to 4, or an anhydride of said acid; and component (B) comprising a heterocylic aromatic amine.

11 Claims, No Drawings

FUEL COMPOSITIONS CONTAINING LUBRICITY ENHANCING SALT COMPOSITIONS

This application is a 371 of PCT/GB99/01064 dated Apr. 7, 1999.

TECHNICAL FIELD

This invention relates to fuel compositions containing lubricity enhancing salt compositions and, more particularly, to fuel compositions containing lubricity enhancing salt compositions wherein the fuel is a diesel fuel.

BACKGROUND OF THE INVENTION

An essential component of a compression ignition internal combustion engine, hereinafter to be referred to as a diesel engine, is a high pressure fuel injector pump, the moving parts of which have hitherto been lubricated by the diesel fuel passing through it. It has long been observed that winter grades of diesel fuel, which are of lower viscosity and contain less waxy fractions than summer grade diesel fuels, have poorer load bearing capacity, or are less capable of lubricating the moving parts of the injector pump, i.e. have poorer lubricity. Recent European regulations have reduced the sulphur content in diesel fuel to 0.05 wt %, and ultra-low sulphur fuels are also now available containing only 0.001 wt % sulphur. Although environmentally beneficial, the reduction in sulphur content has certain disadvantages. In particular, it reduces the lubricity of the diesel fuel, and as a result problems have been reported with excessive wear, including the premature failure of the load bearing parts of certain manufactures of injector pump.

This problem has been addressed by adding to the fuel additives which impart anti-wear properties and improved lubricity to the fuel. For example U.S. Pat. No. 4,849,119 discloses fuels containing friction-reducing additives which comprise a diamine dicarboxylate, made by reacting together a diamine and an organic monocarboxylic acid. The diamine has the formula $RR^1N—R^2—NR^3R^4$, where R, $R^1$, $R^3$ and $R^4$ are H or $C_6$–$C_{20}$ hydrocarbyl, and $R^2$ is $C_2$–$C_4$ hydrocarbylene. It is stated that the hydrocarbyl group may also be aryl, although no examples are given.

EP-A-798364 discloses as lubricity additives for diesel fuel salts of a carboxylic acid and an aliphatic amine.

It has now been discovered that salts of certain carboxylic acids and aromatic heterocyclic amines are unexpectedly effective in enhancing the lubricity of hydrocarbon fuels, especially diesel fuels.

SUMMARY OF THE INVENTION

This invention relates to a fuel composition comprising a major amount of a hydrocarbon fuel and a minor lubricity improving amount of a composition made by reacting component (A) with component (B) under salt-forming conditions;

component (A) comprising carboxylic acid represented by the formula $$R(COOH)_n$$

wherein R is a hydrocarbon group of 2 to 30 carbon atoms and n is a number in the range of 1 to 4, or an anhydride of said acid; and component (B) comprising a heterocylic aromatic amine.

DETAILED DESCRIPTION OF THE PREFERRED EMBODIMENTS

The carboxylic acids (A) are represented by the formula $R(COOH)_n$ where R is hydrocarbon group of 2 to 30 carbon atoms, and n is an integer of from 1 to 4. In one embodiment, n is 1 or 2, and preferably n is 1. In one embodiment, R contains 8 to 24 carbon atoms. In a preferred embodiment, R contains 12 to 20 carbon atoms. R is preferably an alkyl or alkenyl group, either straight chained or branched. Examples of such carboxylic acids include lauric acid, myristic acid, palmitic acid, stearic acid, isostearic acid, arachic acid, behenic acid, lignoceric acid, cerotic acid, montanic acid, melissic acid, caproleic acid, oleic acid, elaidic acid, linoleic acid, coconut oil fatty acid, soy bean fatty acid, tall oil fatty acid, fish oil fatty acid, rapeseed oil fatty acid, tallow oil fatty acid, and palm oil fatty acid. Also included are hydrocarbon-substituted succinic acids or anhydrides thereof wherein the hydrocarbon group contains 2 to 30 carbon atoms, and in one embodiment 8 to 24 carbon atoms, and in one embodiment 12 to 20 carbon atoms. Particularly preferred is tall oil fatty acid (TOFA).

The heterocyclic aromatic amine (B) can be any heterocyclic aromatic amine that is soluble in the hydrocarbon fuel, particularly diesel fuel, and can form a salt with the acid (A). The amines that are useful include pyridine, pyrazine, pyrrole, pyrazole, imidazole, indole, isoindole, purine, azocine, azecine, 1-(2-aminoethyl)-2-methyl-2 imidazoline, and mixtures of two or more thereof. Preferred amines include pyridine, pyrazine, pyrrole, pyrazole, and imidazole. Imidazole is especially preferred.

The reaction between components (A) and (B) is carried out under salt forming conditions using conventional techniques. Typically, one or more of components (A) and one or more of components (B) are mixed together and heated to a temperature in the range of 0° C. up to the decomposition temperature of the reaction components and/or product having the lowest such temperature, and in one embodiment 0° C. to 120° C., and in one embodiment 20° C. to 90° C., and in one embodiment 25° C. to 50° C.; optionally, in the presence of a normally liquid, substantially inert organic liquid solvent/diluent, until the desired product has formed. In one embodiment, the salt of the invention is prepared by simply adding the amine to the carboxylic acid and stirring, optionally with heating in order to dissolve the amine if solid. Components (A) and (B) are preferably reacted in amounts sufficient to provide from 0.4 equivalent of component (B) per equivalent of component (A) up to an excess of component (B), and in one embodiment from 0.4 to 1.4 equivalent of component (B) per equivalent of component (A), and in one embodiment from 0.8 to 1.2 equivalent of component (B) per equivalent of component (A), and in one embodiment from 0.85 to 1.05 equivalent of component (B) per equivalent of component (A). For purposes of this invention, an equivalent of component (A) depends on the total number of carboxyl groups present that are capable of forming a salt with component (B). Thus, for example, one mole of propionic acid would be equal to one equivalent of thereof. One mole of a hydrocarbon substituted succinic acid would be equal to two equivalents of the acid. An equivalent of component (B) depends on the total number of nitrogens present in the molecule that are sufficiently basic to form a salt with component (A). One mole of an amine having one nitrogen capable of forming such a salt would be equal to one equivalent thereof. One mole of an amine having two such nitrogen atoms would be equal to two equivalents of the amine.

The fuel compositions of the present invention contain a major proportion of a normally liquid fuel, usually a hydrocarbonaceous petroleum distillate fuel such as gasoline as defined by ASTM Specification D439, or diesel fuel or fuel oil as defined by ASTM Specification D396. Normally liquid fuel compositions comprising non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more non-hydrocarbonaceous materials are also contemplated. Examples of such mixtures are combinations of gasoline and ethanol, and diesel fuel and ether.

The fuel compositions may contain, in addition to the salt composition of this invention, other additives which are well known to those of skill in the art. These include anti-knock agents such as tetraalkyl lead compounds, lead scavengers such as haloalkanes (e.g., ethylene dichloride and ethylene dibromide), deposit preventers or modifiers such as triaryl phosphates, dyes, cetane improvers, antioxidants such as 2,6-di-tertiary-butyl-4-methyl-phenol, corrosion inhibitors such as alkylated succinic acids and anyhydrides, bacteriostatic agents, gum inhibitors, metal deactivators, demulsifiers, foam inhibitors, upper cylinder lubricants, anit-icing agents, and the like.

Although the salt compositions of the invention can be used in other hydrocarbon fuels, it is with diesel fuels, especially automotive diesel fuels, that this invention is particularly useful. The diesel fuels are typically middle distillate fuel oils which generally boil in the range 150 to 400° C., for example 170 to 350° C. These diesel fuels typically comprise several hydrocarbon fractions. In one embodiment at least 90% by volume, and in one embodiment greater than 95% by volume, of the fuel is recoverable by distillation at 350° C.; and at least 10% by volume, preferably at least 15% by volume at 180° C. The aromatic content of the diesel fuel is typically less than 40% by volume, and in one embodiment less than 30% by volume, and in one embodiment less than 20% by volume. The cetane number of the fuel is generally greater than 40, and in one embodiment greater than 45, and in one embodiment greater than 50. In addition, the sulphur content is generally less than 0.5%, by weight, and in one embodiment less than 0.2% by weight, and in one embodiment less than 0.05% by weight. The salt compositions of the present invention are especially useful for those diesel fuels generally referred to as winter grade diesel fuels and those commercially available fuels which are of lower sulphur content and lower aromatic content than conventional diesel fuels. Typical of the latter is a fuel generally referred to as MK1 diesel fuel which has the following characteristics:

| | |
|---|---|
| Cetane number | 50 min. |
| 95% distillation recovery temperature | 300° C. max. |
| Aromatic content | 5% max. |
| Sulphur | 10 ppm max. |
| Density | 0.8 to 0.82 |
| Viscosity at 40° C. | 1.7 cSt |

The fuel compositions of the invention contain an effective amount of one or more of the salt compositions described above to improve the lubricity of the fuel. The concentration of these salts in the fuel is typically from 15 to 400 parts of said salt per million parts of fuel, and in one embodiment from 40 to 120 parts of said per million parts of fuel.

The salt compositions of the invention can be added directly to the fuel, or they can be diluted with a substantially inert, normally liquid organic diluent such as naphtha, benzene, toluene, xylene or a normally liquid fuel, to form an additive concentrate. These concentrates generally contain from about 10% to about 90% by weight of the salt compositions of this invention. These concentrates may also contain one or more other conventional additives known in the art or described hereinabove.

An advantage of the salt compositions of the invention is that they provide excellent anti-wear properties to fuels, especially diesel fuels, at significantly lower concentrations than known additives currently available.

EXAMPLES

Salts of tall oil fatty acid (TOFA) and a number of heterocyclic aromatic amines are prepared as follows. In each case the amine is added to the TOFA and stirred until the reaction appears to be complete: either when there is no more exotherm, or in the case of solid amines when all the amine has dissolved. The molar ratio of amine to TOFA is 1:1. The amounts of reactants used are as follows:

TABLE 1

| EXAMPLE | AMINE | AMOUNT OF AMINE (g) | AMOUNT OF TOFA (g) |
|---|---|---|---|
| 1 | Pyridine | 54 | 200 |
| 2 | Pyrrole | 45.8 | 200 |
| 3 | Pyrazine | 41 | 150 |
| 4 | Pyrazole | 46.5 | 200 |
| 5 | Imidazole | 46.5 | 200 |

The salts are subjected to the High Frequency Reciprocating Rig (HFRR) Test, which is a recognised test according to CEC-F-06-T94 for evaluating lubricity and anti-wear characteristics of diesel fuels. A test portion of the fluid (fuel) is placed in a reservoir in which the fluid temperature is maintained at a specified value. A fixed steel ball held in a vertically mounted chuck is forced against a horizontally mounted stationary steel plate with an applied load. The test ball is oscillated at a fixed frequency and stroke length while the interface with the plate is fully immersed in the reservoir. The diameter of the wear scar generated on the test ball after a certain time is measured.

The conditions employed for testing diesel fuel containing the additives of the present invention are given in Table 2.

TABLE 2

| | |
|---|---|
| Fluid volume, ml | 2.0 ± 0.2 |
| Stroke Length | 1.00 ± 0.02 |
| Frequency, Hz | 50 ± 1 |
| Relative humidity, % | Above 30 |
| Fluid temperature, ° C. | 60 ± 2 |
| Applied load, g | 200 ± 1 |
| Test duration, min | 75.0 ± 0.1 |
| Bath surface area, $mm^3$ | 600 ± 100 |

The test plate consists of AISI E-52100 steel (chromium alloy steel) machined from annealed rod, having a Vickers hardness 'HV 30' scale number of 190 to 210. The plate is turned, lapped and polished to a surface finish of less than 0.02 $\mu$m $R_a$. The test ball is 6.00 mm diameter, grade 24 of ANSI B3.12 (Metal balls) of AISI E-52100 steel (chromium alloy steel). The ball has a Rockwell hardness 'C' scale (HRC) number of 58 to 66, and a surface finish of less than 0.05 $\mu$m $R_a$. The test plates and balls are supplied from an identical production batch.

The wear scar is measured using a microscope at 100 magnification such that the wear is centred in the field of view. The wear scar diameter, WSD, in micrometers is calculated using the following equation: WSD=(M+N)/2 where M is the average of at least two readings of the major axis of diameter ($\mu$m) and N is the average of at least two readings of the minor axis diameter ($\mu$m). A value of less than 470 $\mu$m is considered a 'pass'.

Solutions comprising the additives of the invention at a concentration of approximately 75 ppm in MK1 diesel fuel described above are tested. The results for wear scar are given in Table 3.

TABLE 3

| EXAMPLE | AMINE | CONC. OF ADDITIVE (ppm) IN FUEL | WEAR SCAR ($\mu$m) |
|---|---|---|---|
| 0 | — | none | 600 |
| 1 | Pyridine | 76 | 256 |
| 2 | Pyrrole | 77 | 308 |
| 3 | Pyrazine | 74 | 402 |
| 4 | Pyrazole | 74 | 261 |
| 5 | Imidazole | 75 | 398 |

These results demonstrate that the inventive additive is very effective at reducing wear, even at low concentrations.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A fuel composition, comprising:

a major amount of a diesel fuel having a sulfur content of less than 0.2% by weight; and a minor lubricity improving amount of a composition made by reacting component (A) with component (B) under salt-forming conditions in a temperature range of 0° C. to 120° C.; component (A) comprising a carboxylic acid represented by the formula $R(COOH)_n$ wherein R is a hydrocarbon group of 2 to 30 carbon atoms and n is a number in the range of 1 to 4, or an anhydride of said acid; and component (B) comprising a heterocyclic aromatic amine wherein the heterocyclic aromatic amine is soluble in the diesel fuel and can form a salt with the component (A) and wherein component (B) is selected from the group consisting of pyridine, pyrazine, pyrrole, pyrazole, imidazole, indole, purine, and mixtures of two or more thereof.

2. The composition of claim 1 wherein n is 1 or 2.

3. The composition of claim 1 wherein R is a saturated or unsaturated aliphatic hydrocarbon group.

4. The composition of claim 1 wherein R has from 8 to 24 carbon atoms.

5. The composition of claim 1 wherein (A) is a fatty acid.

6. The composition of claim 1 wherein the component (A) is selected from the group consisting of lauric acid, myristic acid, palmitic acid, stearic acid, isostearic acid, arachidic acid, behenic acid, lignoceric acid, cerotic acid, montanic acid, melissic acid, caproleic acid, oleic acid, elaidic acid, linolenic acid, linoleic acid, hydrocarbon-substituted succinic acid or anhydride, coconut oil fatty acid, fish oil fatty acid, soybean fatty acid, tall oil fatty acid, rapeseed oil fatty acid, tallow oil fatty acid, palm oil fatty acid, and mixtures of two or more thereof.

7. The composition of claim 1 wherein (A) is tall oil fatty acid.

8. The fuel composition of claim 1 wherein the component (A) is tall oil fatty acid and the component (B) is imidazole.

9. The composition of claim 1 wherein (B) is selected from the group consisting of pyridine, pyrazine, pyrrole, pyrazole, imidazole, and mixtures of two or more thereof.

10. The composition of claim 1 wherein (B) is imidazole.

11. The composition of claim 1 wherein from 0.4 equivalents of component (B) per equivalent of component (A) up to an excess of component (B) is present in the reaction between component (A) and component (B).

* * * * *